United States Patent [19]

Lichowsky

[11] 4,193,171

[45] Mar. 18, 1980

[54] SKI BOOT TIGHTENING BUCKLE

[76] Inventor: Abraham Lichowsky, 220 S. Cliffwood, Los Angeles, Calif. 90049

[21] Appl. No.: 942,990

[22] Filed: Sep. 18, 1978

[51] Int. Cl.[2] ..... A44B 21/00; A43C 11/00

[52] U.S. Cl. ..... 24/68 SK; 254/73

[58] Field of Search ..... 24/68 SK, 68 D, 68 T, 24/68 R; 254/73, 71, 79

[56] References Cited

U.S. PATENT DOCUMENTS

| | | | |
|---|---|---|---|
| 1,278,069 | 9/1918 | MacDonald | 254/73 |
| 3,643,295 | 2/1972 | Schoch | 24/70 SK |
| 3,662,435 | 5/1972 | Allsop | 24/70 SK |
| 3,887,966 | 6/1975 | Gley | 254/79 |

FOREIGN PATENT DOCUMENTS

| | | | |
|---|---|---|---|
| 67792 | 3/1914 | Switzerland | 254/73 |
| 3440 | of 1908 | United Kingdom | 254/71 |

*Primary Examiner*—Ramon S. Britts
*Attorney, Agent, or Firm*—Ralph B. Pastoriza

[57] ABSTRACT

The buckle includes an anchor secured on one side portion of the front of a ski boot and a buckle structure coupled to the opposite side portion of the ski boot. The buckle structure includes a flexible metal strip coupled at one end to the said opposite portion of the ski boot and having its other end pass through a manually operable lever drive mechanism capable of incrementally driving the strip through the drive mechanism. With this arrangement, the lever drive mechanism can be manually hooked to the anchor on the one side of the ski boot and then actuated to incrementally drive the strip through the mechanism thereby tightening the boot to any desired degree. By providing a continuous smooth engaging surface on the strip, the drive mechanism effectively can adjust the degree of tightening through an infinite number of incremental positions. Further, by swinging the lever mechanism completely open, the strip can move freely backwardly or forwardly to enable easy manual removal of the drive mechanism and strip from the anchor to completely open up the front of the ski boot thereby greatly facilitating putting the boot on and taking it off.

4 Claims, 7 Drawing Figures

SKI BOOT TIGHTENING BUCKLE

BACKGROUND OF THE INVENTION

Conventional ski boot buckles have proven to be very difficult to operate especially under adverse weather conditions. Many types of presently available buckles operate on an overcenter snap arrangement which can result in tightening beyond a desired degree and which can also result in inadvertent snapping open of the buckle under stress conditions. Moreover, the incrementally adjustable positions of present day buckles are fairly coarse so that an optimum comfortable tightening condition is difficult to achieve.

In addition to the foregoing, the sophisticated structure of presently manufactured ski boots wherein fairly stiff boot walls are required for proper foot and ankle support results in considerable strength on the part of the user being required for operating the buckling of the boot. Again, the matter is aggravated after the boots have been in use because of swelling of the feet and the like requiring readjustment of the degree of tightness. As stated, such readjustment under snow conditions is difficult.

Many of the foregoing problems have been resolved by the provision of a ratchet type buckle. This buckle provides a large mechanical advantage to a user and permits incremental tightening of the boot in steps determined by the dimensions of the ratcheting teeth. An example of this prior art type of ratcheting buckle is disclosed in U.S. Pat. No. 3,662,435 issued May 16, 1972 to Ivor J. Allsop.

Notwithstanding the foregoing improved ratchet type buckle arrangement for ski boots, there are still major problems involved. First, the ratcheting buckle in general remains coupled to the one side of the front of the ski boot while the ratcheting rack or strip member is coupled to the other side, opening up of the opposed front portions of the boot being accomplished by sliding the ratchet strip free of the buckle portion. This operation can be somewhat of a nuisance since it is then necessary to attempt to feed the free end of the strip back through the buckle in subsequent tightening up of the boot. This necessity of refeeding the strip can be avoided by having the end of the strip designed to remain coupled to the buckle itself but in this situation there is not always assured enough slack when the strip is pulled from the buckle to its extreme position to permit easy putting on and taking off of the boot. It is clearly desirable that any type of buckle arrangement be such that complete separation of the cooperating parts of the buckle can be achieved so that the opposed front portions of the boot may be completely opened for easy entry of the skier's foot.

Second, even though the ratchet teeth of ratchet type buckles can be spaced fairly close together so as to provide a fine degree of incremental adjustment, if the positions are too close, the teeth wear out under high stress.

SUMMARY OF THE INVENTION

Bearing the foregoing in mind, the present invention contemplates the provision of an improved ski boot tightening buckle similar in many aspects to a ratchet type tightening buckle such as shown in the above referred to U.S. Patent but so designed as to overcome the referred to problems associated with prior art ratchet buckle arrangements.

More particularly, in accord with the present invention an anchor means is secured on one side portion of the front of the ski boot and a buckle means coupled to the opposite side portion of the front of the ski boot for easy manual attachment to the anchor means so that tightening of the buckle after attachment draws the one side and opposite side towards each other to tighten the boot. The buckle means itself includes a flexible metal strip coupled at one end to the opposite side portion of the front of the ski boot and a lever drive means for receiving the other end of the flexible strip for incremental movement of the strip therethrough upon actuation to thereby effect the tightening.

The flexible strip has a continuous smooth engaging surface for engagement by the lever drive means to provide effectively an infinite number of incrementally adjustable positions. Moreover, the drive lever means is movable to a completely closed position to lock the strip in an adjusted position and movable to a completely open position in which the strip is disengaged so that it can freely move through the lever drive means.

The extreme free end of the strip is designed to always remain coupled to the lever drive means so that complete opening of the opposed front portions of the ski boot is accomplished by simply manually detaching the lever drive means from the anchor means.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE PREFERRED EMBODIMENT

Figure 1:
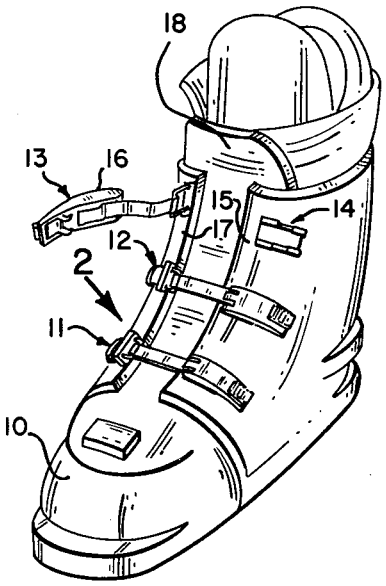
FIG. 1 is a perspective view of a ski boot having ski boot tightening buckles in accord with the present invention, one of the buckles being shown in open position.

Referring first to FIG. 1, there is shown a ski boot 10 provided with ski boot tightening buckles 11, 12 and 13 each designed in accord with the present invention. In FIG. 1, the buckle 13 is shown in open position while the other buckles 11 and 12 are shown closed.

Considering specifically the buckle 13, the structure includes in combination an anchor means designated generally by the arrow 14 secured on one side portion 15 of the front of the ski boot 10 as shown. Buckle means 16, in turn is coupled to the opposite side portion 17 of the front of the ski boot for manual attachment to the anchor means 14 so that tightening of the buckle means after attachment, all as will be described shortly, draws the one side and opposite side 15 and 17 towards each other to tighten the boot. This closure takes place over the ski boot tongue 18.

Figure 2:
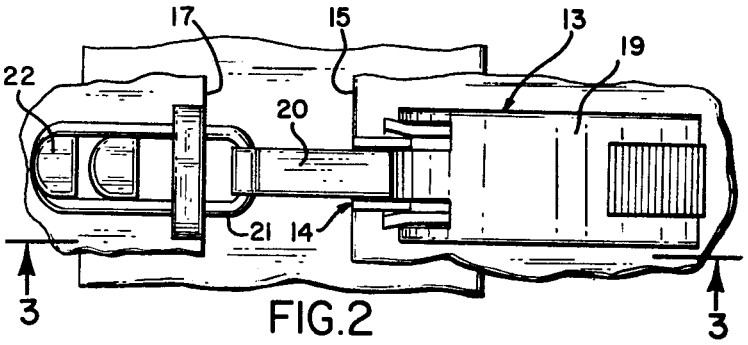
FIG. 2 is a fragmentary top plan view of the one buckle of FIG. 1 designated by the arrow 2 after it has been secured in completely closed position.

Each of the buckles 11, 12 and 13 of FIG. 1 are identical in construction and therefore a detailed description of one will suffice for all. Thus, referring now to the plan view of FIG. 2 which illustrates the buckle 13 secured in completely closed position to the anchor means 14, the structure includes a lever drive means including a buckle lever 19. A flexible metal strip 20 has one end coupled at 21 to the referred to opposite side portion 17 of the front of the ski boot, this coupling taking the form of a cable about which the one end of the strip 20 is hooked, the other end of the cable being receivable over appropriate projections 22.

The lever drive mechanism receives the other end of the flexible strip 20 which passes therethrough beneath the buckle lever 19.

Figure 3:
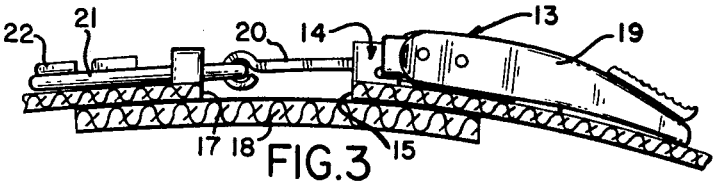
FIG. 3 is a cross section of a portion of the ski boot of FIG. 1 showing a side elevational view of the one buckle taken in the direction of the arrows 3—3 of FIG. 2.

In the side elevational view of FIG. 3, the coupling of the one end of the strip 20 to the cable 21 passing about projection 22 on the referred to opposite side portion 17 of the front of the ski boot is clearly illustrated.

The drive mechanism as will be subsequently described is designed to incrementally move the flexible metal strip 20 by movement of the buckle lever 19 between open and closed positions so that the opposed edge portions 15 and 17 are drawn together over the ski boot tongue 18.

Figure 4:
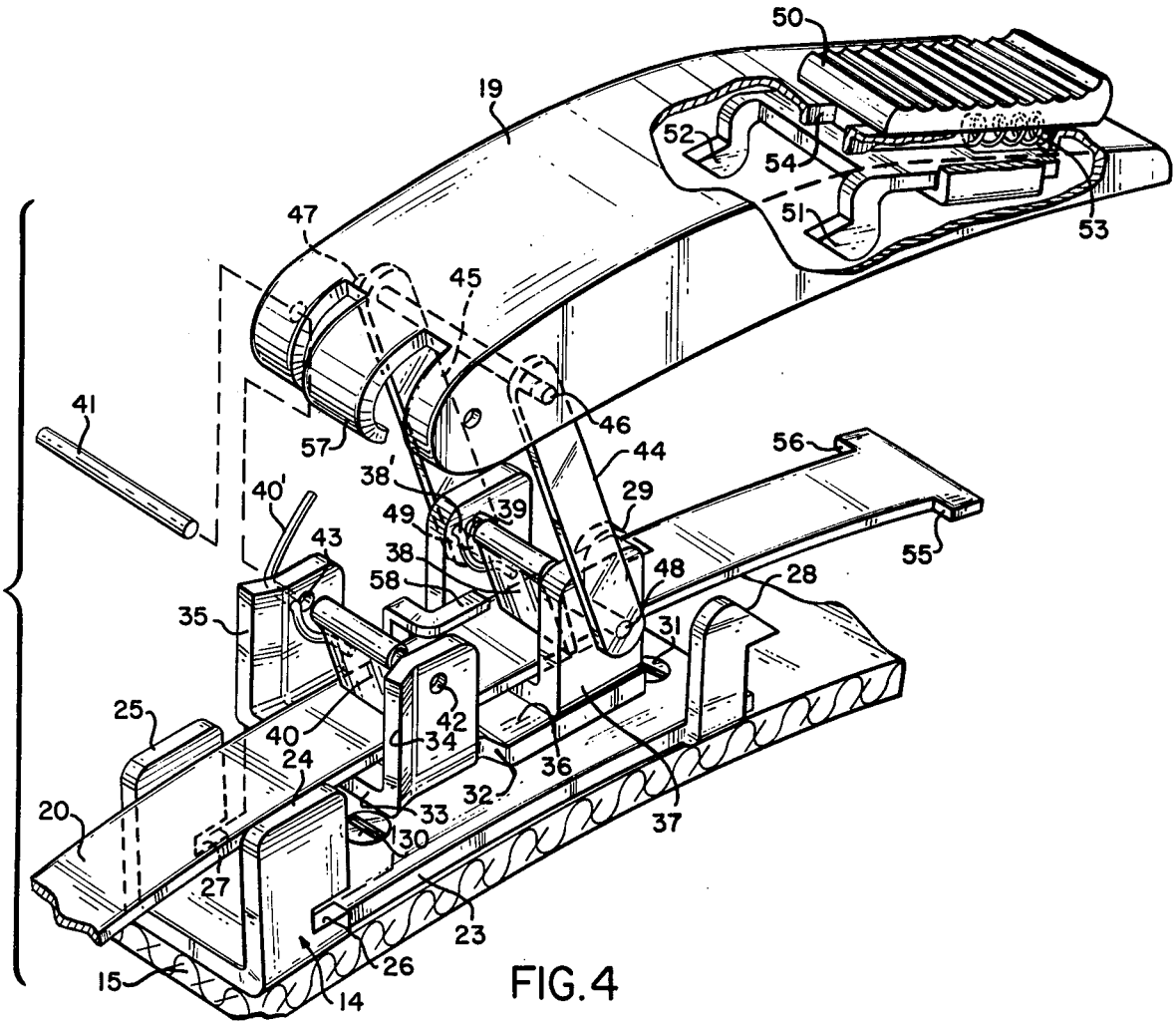
FIG. 4 is an enlarged exploded perspective view of the basic components making up the ski boot buckle of this invention.

The manner in which the foregoing operates will now best be understood by reference to the exploded perspective view of FIG. 4.

Referring to the lower left portion of FIG. 4, the anchor means designated generally by the arrow 14 described in FIG. 1 takes the form of a metal elongated plate 23 having upwardly extending walls 24 and 25 at its front portion. These walls have anchoring recesses 26 and 27 formed in their rear edges as shown.

The rear end of the plate 23 shown in the upper right portion of FIG. 4 terminates in hook means 28 and 29. The anchoring plate 23 is permanently secured to the one side portion 15 of the front of the ski boot as by appropriate fastening means 30 and 31.

The driving mechanism or buckle means is shown exploded above the anchor plate 23 and in turn includes a slide plate 32 having a front end portion 33 including opposite upwardly extending wall portions 34 and 35. The front vertical edges of the wall portions are flared outwardly slightly as shown. The front portion of the slide plate 32 is raised slightly as shown so that the front edge 33 can be received and anchored in the anchor slots 26 and 27 of the anchor means 14. When so assembled, the flared walls 34 and 35 will straddle the outside surfaces of the walls 24 and 25 of the anchor means.

Essentially, the slide plate 32 defines a smooth sliding surface 36 upon which a carriage is positioned for sliding movement in forward and rearward directions. In the description of the buckle means of this invention, a forward direction is indicated by the arrows designated Forward and Rearward.

Referring specifically to the carriage structure 37, there is provided a drive pawl 38 pivoted to the carriage as at 39 and depending downwardly as shown. A clutch pawl 40, in turn, is arranged to be pivoted as by pivot rod 41 between the upwardly extending flared walls 34 and 35 at the front end portion of the slide plate 32. Appropriate pivot rod openings 42 and 43 are illustrated for this purpose.

With respect to the foregoing, it will be understood that the front end portion of the buckle lever 19 shown exploded in FIG. 4 is also pivoted to the same pivot rod 41 when the various parts are assembled. In other words, the buckle lever 19 is pivoted to the front end portion of the slide plate 32.

The flexible strip 20 is shown in FIG. 4 passing beneath the clutch pawl 40 and extending rearwardly through the carriage 37 beneath the drive pawl 38 and thence out the rear of the mechanism. The clutch pawl 40 and drive pawl 38 are biased by springs 40′ and 38′ to have their depending ends engage the top smooth surface of the strip 20 at longitudinally spaced points, the pawls forming an angle to the vertical.

Still referring to FIG. 4, there are provided drive link means in the form of the link members 44 nd 45 pivoted to the buckle lever 19 as at 46 and 47 and at their opposite ends to the carriage 37 as at 48 and 49. The arrangement is such that when the buckle lever 19 has its front end portion pivoted to the rod 41, swinging movement of the buckle lever 19 between open and closed positions about the pivot rod 41 results in the link members 44 and 45 sliding the carriage 37 forwardly and rearwardly along the top surface of the slide plate 32.

Referring now to the rear end portion of the buckle lever 19, there is indicated generally by the arrow 50 a hook engaging means including hooks 51 and 52 arranged to engage the hooks 28 and 29 at the rear of the anchor plate wherein the buckle lever 19 is in completely closed position thus locking the buckle lever. The manner in which this hook engaging means 50 is released to enable operation of the buckle lever 19 will become clearer as the description proceeds.

Figure 5:
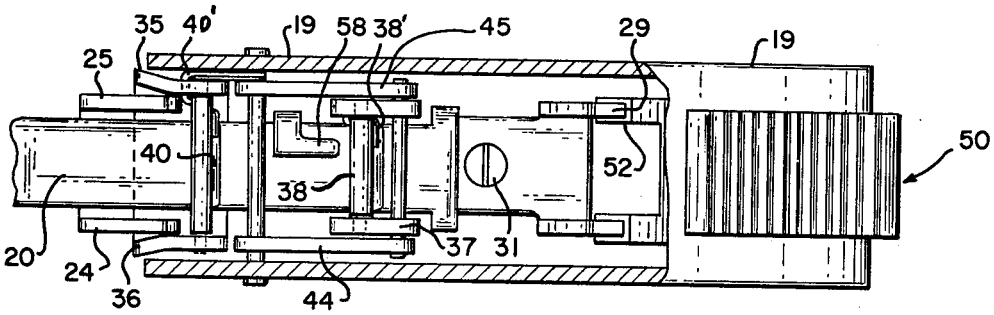
FIG. 5 is a fragmentary top plan view of certain components of the buckle of FIG. 4 in assembled relationship.

Referring now to the fragmentary plan view of FIG. 5, the buckle lever 19 is shown pivoted to the pivot rod 41, the pivoting connection of the drive link members 44 and 45 between the buckle member 19 and carriage 37 being evident. Also shown in FIG. 5 is the flexible strip 20 passing beneath the clutch pawl 40 and the drive pawl 38.

Figure 6:
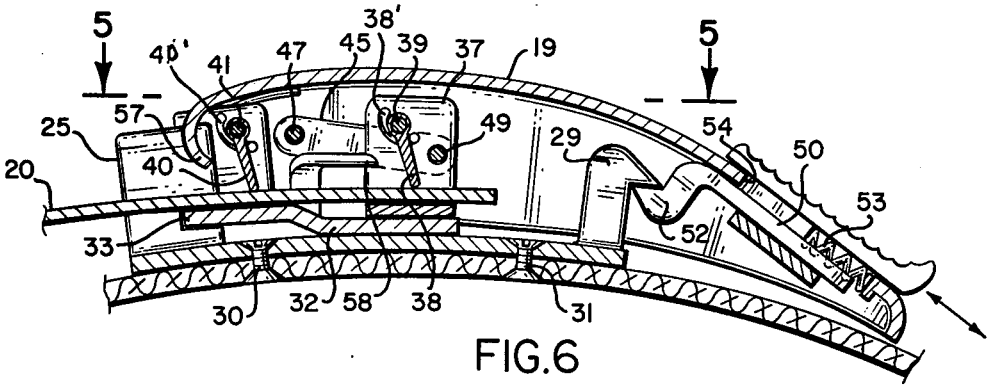
FIG. 6 is an enlarged side cross sectional view of the buckle in completely closed position.

FIG. 6 shows the assembled buckle means in side cross section wherein the buckle lever 19 is in completely closed position. In FIG. 6, it will be noted that the hook engaging means such as the hook 52 on the rear end of the buckle lever 19 is spring biased by a spring 53 in a forward direction, the means 50 riding in a slot 54 formed in the rear portion of the buckle lever. The forward undersides of the hooks 51 and 52 in FIG. 4 and shown at 52 in FIG. 6 provide a camming surface for engaging opposed rearwardly upwardly sloping edges of the hooks 28 and 29 of the anchor plate. These surfaces will slide relatively to each other to retract the engaging hooks 50 when the buckle lever 19 is moved towards closed position, the hooks then snapping under the anchor hooks to lock the buckle lever 19 in its closed position as illustrated in FIG. 6. The hook engaging means 50 can be manually slid rearwardly against the bias of the spring 53 to release the hooks when it is desired to operate the mechanism or to effect complete disengagement of the buckle from the anchor means. Lateral ears 55 and 56 on the end of strip 20 couples the buckle to the strip.

The resting engagement of the clutch pawl 40 and drive pawl 38 with the top surface of the strip 20 is clearly shown in FIG. 6, the inclination with the vertical being forwardly in an upward direction.

Figure 7:
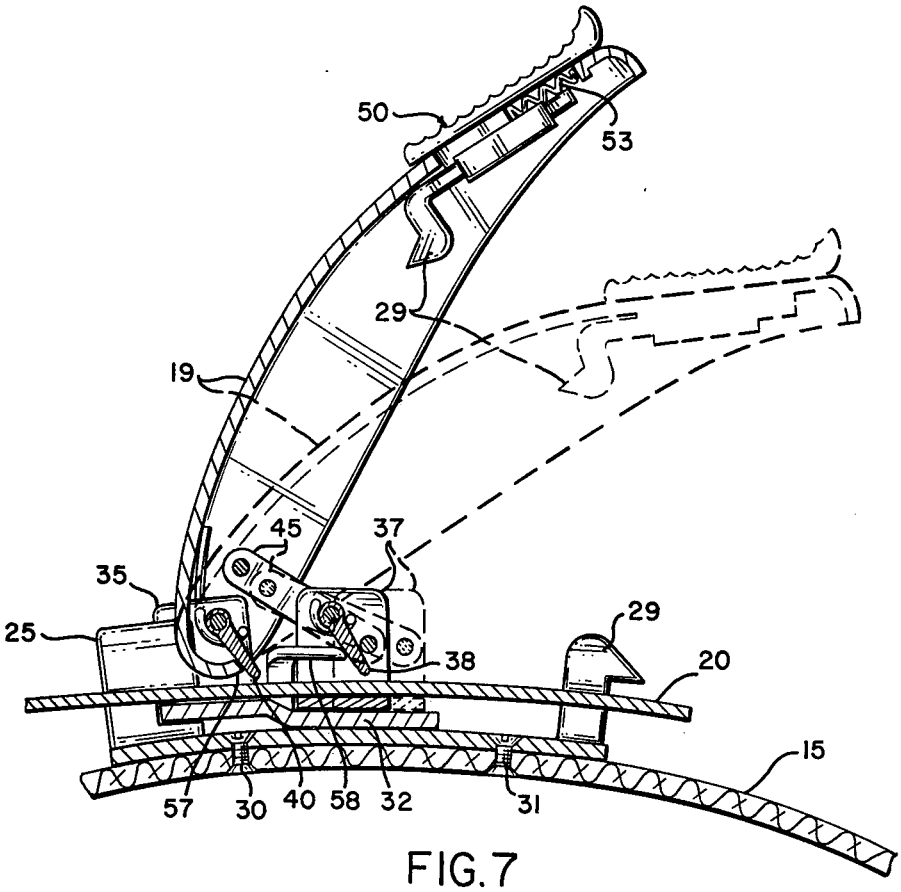
FIG. 7 is a view similar to FIG. 6 but showing the buckle in an intermediate operative position together with a phantom line showing of the buckle in completely open position.

FIG. 7 is a view similar to FIG. 6 but showing the hook engaging means 50 disengaged from the anchor hooks 29 with the buckle lever 19 in a phantom line position between its completely closed position and its completely open position. In FIG. 7, it will be noted that the position of carriage 37 has shifted forwardly along the slide plate 32 as a consequence of raising of the buckle lever 19, this movement being effected through the drive link members such as the member 45. Such movement will simply result in the drive pawl 38 sliding along the top surface of the strip 20, the clutch pawl 40 thoroughly locking the strip 20 from movement to the left as oriented in FIG. 7.

Downward movement of the buckle lever 19 will in turn move the carriage 37 to the right or in a rearward direction through the medium of the link member 45 resulting in the drive pawl 38 frictionally engaging the top surface of the strip 20 to incrementally move it to the right or rearwardly as viewed in FIG. 7. It will be evident that up and down swinging movement of the buckle lever 19 will thereby effect incremental movements and inasmuch as the top surface of the flexible strip 20 is continuous and smooth, there are no set incrementally adjusted positions; rather, there are in effect an infinite number of such incrementally adjustable positions.

Still referring to FIG. 7, there is shown by the solid lines a completely open position of the buckle lever 19. It will be noted that the central extreme front end of the buckle member 19 includes a downwardly and slightly rearwardly projecting portion 57. This portion 57 constitutes a clutch pawl engaging means and is positioned to engage and move the clutch pawl 40 away from the strip 20 when the buckle lever is swung to its completely open position.

Also shown in FIG. 7 is a drive pawl engaging means in the form of a projecting member secured to the slide plate 32 in a stationary position indicated at 58. This engaging member is so positioned that when the carriage 37 is moved further forwardly or to the left as viewed in FIG. 7 resulting from movement of the buckle lever 19 to its completely open position, the drive pawl 38 will be engaged thereby and moved away from the strip 20.

When the buckle lever 19 is in the completely open or solid line position of FIG. 7, it will thus be evident that the flexible strip 20 can slide freely through the drive mechanism. The small laterally extending ears 55 and 56 at the extreme end of the flexible strip 20 will prevent its complete separation from the buckle so that the strip 20 essentially ties the components of the buckle together.

OPERATION

The operation of the buckle of this invention will be evident from the foregoing description.

With reference once again to FIG. 1, assume that all of the buckles 11, 12 and 13 are in the completely open position as illustrated for the buckle 13. It can be seen that the buckle structure 16 in FIG. 1 is coupled to the end of the flexible strip but that the opposed front edges 15 and 17 of the ski boot are completely open so that a skier can easily put the ski boot on and take it off.

When the ski boot has been placed on the skier's foot, he then need only grasp the buckle 16 and hook the front end portion 33 of the slide plate 32 into the slots 26 and 27 of the anchor walls 24 and 25 illustrated in detail in FIG. 4. The front upwardly extending flared walls 34 and 35 of the front end portion of the slide plate 32 will straddle the outer surfaces of the anchor walls 24 and 25 and thus hold the buckle structure securely.

Thereafter, with the buckle lever 19 in its completely open position, illustrated in FIG. 7 in solid lines, the strip 20 can be manually pushed from left to right as viewed in FIG. 7 under the pawls to bring the opposed sides 15 and 17 of the ski boot together. Thereafter, downward movement of the buckle lever 19 will disengage the pawl engaging means 57 and 58 shown in FIG. 7 permitting the springs to seat the tips on the top surface of the strip 20. Further downward movement of the buckle lever 19 towards its closed position illustrated in FIG. 6 will drive the carriage 37 to the right as viewed in FIG. 7 resulting in the drive pawl 38 incrementally moving the flexible strip 20 to the right. The lever buckle 19 is not pushed down to completely closed position but only to a point where the camming surfaces of the cooperating hooks 52 and 29 are close to each other. In other words, the buckle lever 19 is simply swung upwardly and downwardly between its phantom position and close to its closed position but not to the extreme positions when operating the mechanism.

Continuous up and down movement of the buckle lever 19 will thus move the carrige 37 forwardly and rearwardly to incrementally drive the strip 20 through the mechanism and effect tightening of the boot.

When a proper degree of tightness has been achieved, the amount of movement effected by each incremental step being carefully controlled by the degree of the arc through which the buckle lever 19 is swung, the buckle lever 19 is lowered to its completely closed position illustrated in FIG. 6 wherein the lever hooks 52 have engaged the anchor hooks 29. The spring 53 will secure the hooks in engagement so that the lever buckle 19 is locked in its completely closed position and there is no possibility of the same snapping open.

When the skier desires to remove his ski boots or simply adjust the degree of tightness of any of the buckles, it is a simple matter for him to slide the hook engaging mechanism 50 illustrated in FIG. 7 rearwardly against the spring 53 and then simply lift up on the lever. Further tightening can readily be effected by then swinging the lever 19 through a controlled arc and relocking the same or, alternatively, swinging the lever to its completely open solid line position illustrated in FIG. 7 wherein the flexible strip 20 can then slide freely in a leftward direction viewed in FIG. 7. This action loosens the boot sufficiently that the skier can then easily unhook the buckle mechanism from the front anchor slots and the entire buckle mechanism with the strip is moved to one side to provide the desired completely open condition.

From all of the foregoing, it will thus be evident that the ski boot tightening buckle of this invention has provided improved features and advantages not available heretofore.

While the tightening buckle has been described as drawing together opposed front side portions of a ski boot, it should be understood that where the opposed side portions are on the side or rear of the boot, the buckle can equally as well be used. In fact, the buckle of this invention has applicability to the drawing together of any two opposed side portions of an object whether a ski boot or other device.

I claim:

1. A ski boot tightening buckle including, in combination:

(a) anchor means secured on one side portion of said ski boot; and (b) buckle means coupled to the opposite side portion of said ski boot for manual attachment to said anchor means so that tightening of said buckle means after attachment draws said one side and opposite side towards each other to tighten said boot, said buckle means including:

(1) a slide plate having a front end portion for hooking to said anchor means and defining a sliding surface extending rearwardly from said front end portion;

(2) a carriage positioned on said slide plate for sliding movement in forward and rearward directions;

(3) a drive pawl pivoted to said carriage;

(4) a clutch pawl pivoted to said slide plate in a position forward of said driving pawl;

(5) a buckle lever pivoted to a portion of said slide plate adjacent to said front end portion;

(6) drive link means pivotally connected at opposite ends to said buckle lever and carriage respectively such that swinging movement of said lever about its pivot between open and closed positions slides said carriage forwardly and rearwardly through said drive link means; and (7) a flexible strip coupled at one end to said opposite side portion of said ski boot and passing under said clutch pawl and through said carriage under said drive pawl, said clutch pawl and drive pawl resting in engagement with the top surface of said strip at an angle to the vertical whereby forward and rearward movement of said carriage drives said strip during each rearward movement in a direction to draw said opposite said portion of said ski boot closer to said one side portion to thereby tighten said ski boot.

2. A ski boot buckle according to claim 1, in which said anchor means includes rearwardly positioned hook means the rear end of said lever including manually releasable hook engaging means cooperating with said hook means to hold said lever when swung downwardly to a completely closed position after tightening of said ski boot to a desired degree.

3. A ski boot buckle according to claim 1, in which the rear end of said flexible strip terminates in laterally extending ears for preventing complete separation of said strip from said slide plate, lever and carriage structure when said buckle means is detached from said anchor means.

4. A ski boot buckle according to claim 1, in which said lever includes clutch pawl engaging means positioned to engage and move said clutch pawl away from said strip when said lever is swung to a completely open position, said slide plate including drive pawl engaging means positioned to engage and move said drive pawl away from said strip when said carriage is moved forwardly to a maximum extent by movement of said lever to said completely open position whereby said strip is free to move forwardly to loosen said ski boot and permit easy manual detachment of said buckle means from said anchor means.

* * * * *